United States Patent [19]

Bashyam

[11] Patent Number: 4,989,293

[45] Date of Patent: Feb. 5, 1991

[54] TENNIS COURT DRYING MACHINE

[76] Inventor: Murali Bashyam, 1417 Elberon Pl., Raleigh, N.C. 27609

[21] Appl. No.: 351,931

[22] Filed: May 15, 1989

[51] Int. Cl.[5] ..... A47L 11/292

[52] U.S. Cl. ..... 15/383; 15/98; 15/119 A; 15/353; 15/97.1; 34/95

[58] Field of Search ..... 15/97 R, 98, 119 A, 15/320, 383; 34/95, 95.3

[56] References Cited

U.S. PATENT DOCUMENTS

| | | | |
|---|---|---|---|
| 3,177,794 | 4/1965 | Laing . | |
| 3,789,449 | 2/1974 | McFarland et al. | 15/4 |
| 3,967,339 | 7/1976 | Newman . | |
| 4,595,420 | 6/1986 | Williams, III et al. | 134/6 |

FOREIGN PATENT DOCUMENTS

| | | | |
|---|---|---|---|
| 543513 | 7/1957 | Canada | 15/98 |
| 696159 | 10/1965 | Italy | 15/98 |
| 58954 | 5/1979 | Japan | 15/98 |
| W83/02789 | 8/1983 | PCT Int'l Appl. | 15/98 |
| 440891 | 1/1936 | United Kingdom | 15/119 A |

*Primary Examiner*—Chris K. Moore

[57] ABSTRACT

A mechanism for removing water from tennis courts. A large roller having a sponge sleeve thereon is rolled over the court surface to pick up water lying on the court surface. As the roller rotates the sponge sleeve moves against a smaller roller that exerts a localized pressure force on the sponge material; water is thus squeezed out of the sponge pores into a collection tank located below the small roller. The mechanism further includes a heating device located behind the large roller to direct heated gas onto the tennis court surface to evaporate moisture that was not picked up by the roller (sponge).

2 Claims, 1 Drawing Sheet

TENNIS COURT DRYING MACHINE

BACKGROUND AND SUMMARY OF THE INVENTION

U.S. Pat. No. 3,967,339 issued to C. Newman, discloses a roller mechanism for moving rain water over a tennis court to assist in drying the court surface. The roller surface is defined by a polyurethane foam sleeve having a relatively low porosity and water-absorbency characteristic. The aim is to have the roller surface make sealing contact with the surface of the tennis court, such that the roller acts as a plow to propel the water over the court surface in front of the roller.

The present invention is directed to a mechanism for removing rain water from tennis courts, but in a somewhat different fashion than as proposed in Newman U.S. Pat. No. 3,967,339. The present invention utilizes a large diameter roller having a sponge sleeve formed of a material having the ability to absorb water into its pores. A second relatively small diameter roller is arranged directly behind the large diameter roller to squeeze the sponge sleeve and thus remove the water that has been removed from the tennis court surface. A water collection tank is arranged below the small diameter roller to receive the water squeezed out of the sponge sleeve.

A source of heated gas is arranged downstream from the water collection tank to heat the still-moist court surface, thereby evaporating most, if not all, of the remaining moisture.

THE DRAWINGS

DESCRIPTION OF A PREFERRED EMBODIMENT OF THE INVENTION

Figure 1:
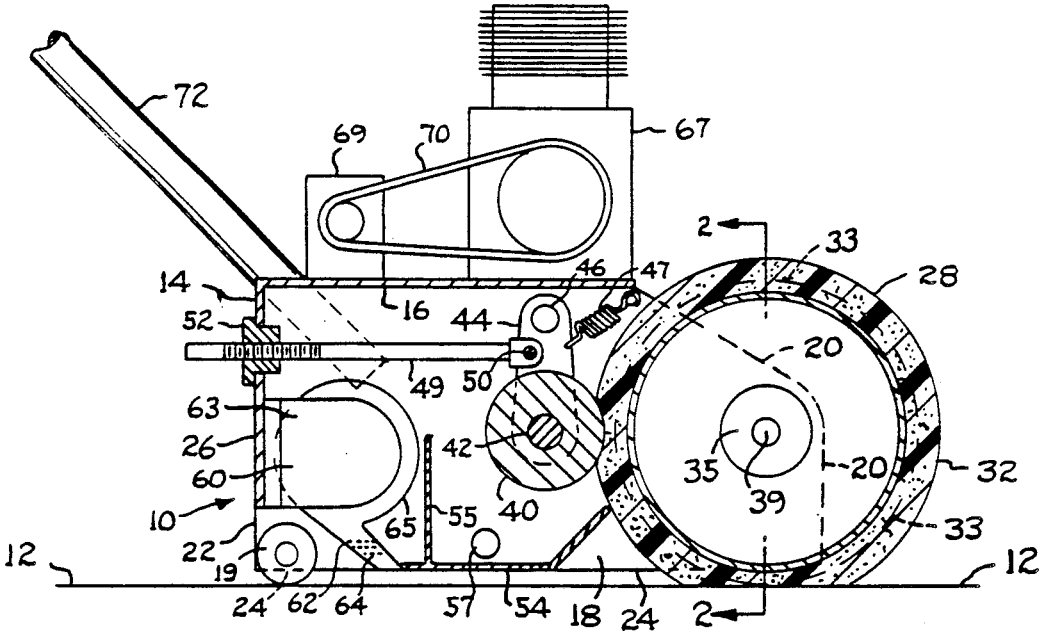
FIG. 1 is a transverse sectional view taken through a mechanism embodying the present invention.

The drawings show a mechanism 10 adapted to be manually pushed along the surface 12 of a tennis court in a left-to-right direction (FIG. 1) for removing rain water from surface 12. The mechanism comprises a carriage 14 that includes a horizontal platform (or deck) 16 and two downwardly extending skirt walls 18. FIG. 1 shows one of the skirt walls as having a front edge 20 and a rear edge 22. The lower edge 24 of the skirt wall extends horizontally from edge 20 to edge 22 in close proximity to court surface 12. A vertical rear wall 26 extends downwardly from platform 16 in the space between the rear edges 22 of the two skirt walls 18. The non-illustrated skirt wall is similar to skirt wall 18 shown in FIG. 1. Two support rollers 19 may be mounted on walls 18 near their rear edges 22.

Figure 2:
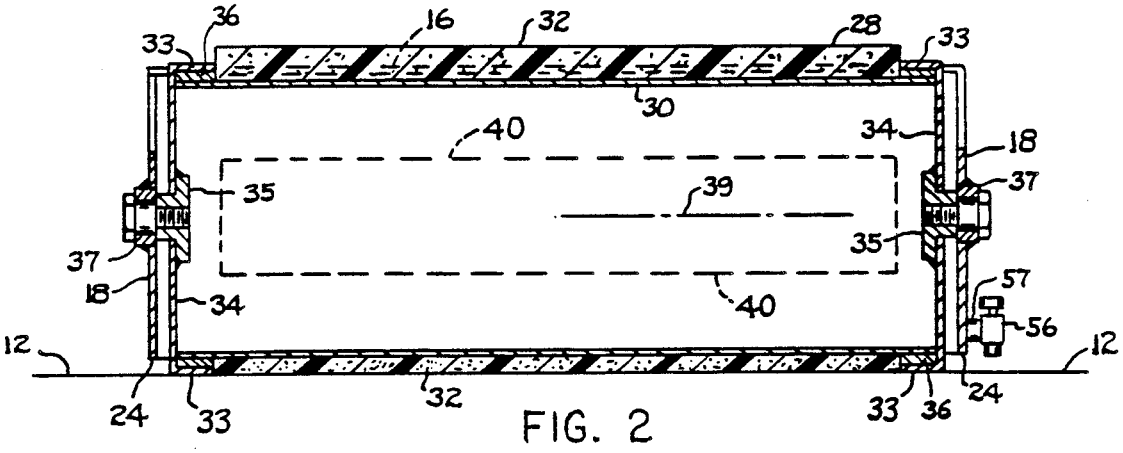
FIG. 2 is a fragmentary sectional view taken on line 2—2 in FIG. 1.

The space between skirt walls 18 accommodates a relatively large diameter roller 28. As shown in FIG. 2, roller 28 comprises a cylindrical steel drum 30 having a sponge sleeve 32 secured thereon. The ends of drum 30 are closed by circular disk walls 34 that have rim flanges 33 adapted to contact court surface 12. Stub shaft assemblies 35 extend from disk walls 34 through sleeve bearings 37 mounted in skirt walls 18, such that roller 28 is supported for rotary motion around shaft axis 39.

The weight of carriage 14 is such that sponge sleeve 32 is compressed as it comes into contact with court surface 12. However, the sponge compression is limited because rim flanges 33 contact the court surface to prevent complete distortion of the sponge material. The diameters of rim flanges 33 are selected to be greater than the diameter of drum 30 but less than the outside diameter of sponge sleeve 32. Flanges 33 can thus serve as protector wheels for the sponge sleeve, in that the sleeve can deform only down to the wall 33 diameter. Annular spacers 36 can be interposed between each flange 33 and the associated surface of drum 30.

During use of the mechanism on a wet tennis court roller 28 will roll on the court surface in a left-to-right direction (FIG. 1), such that sponge sleeve 32 will absorb (adsorb) surface water into its pores as it progressively moves over court surface 12. Protector wheels 33 limit the sponge deformation and thus prevent the absorbed water from being prematurely (immediately) squeezed out of the pores in the sponge material.

As roller 28 rotates in a clockwise direction (FIG. 1) it encounters a small diameter roller 40 that is freely rotatable on an elongated transverse shaft 42. The opposite ends of shaft 42 are affixed to two pendulum arms 44 that are swingably attached to skirt walls 18 via stub shafts 46. Tension springs 47 are trained between arms 44 and anchorages on walls 18, such that roller 40 is drawn against the surface of sponge sleeve 32. Roller 40 is formed of steel, hard rubber, hard plastic, etc., such that the roller can act to squeeze water out of the pores in sponge sleeve 32.

The contact pressure between roller 40 and the sponge sleeve surface can be varied (or removed entirely) by a manual rod 49. As shown, rod 49 has one end thereof pivotably connected to a transverse shaft 50 extending between the two pendulum arms 44. The other end of rod 49 extends through a manually-rotatable nut 52 mounted on carriage rear wall 26. Manual (hand) rotation of nut 52 can be used to draw rod 49 rearwardly, to thus move roller 40 away from the surface of sponge sleeve 32. Reverse rotation of nut 52 allows spring 47 to pull roller 40 toward the surface of sponge sleeve 32. The adjustment system is used to vary the contact pressure between roller 40 and the sponge sleeve surface, such that sufficient water is removed from the sponge material to restore the sponge to a condition for pick-up of new water from court surface 12 on the next contact with surface 12. The squeeze action of roller 40 on the sponge surface takes place continuously as roller 28 rolls along a water-coated surface 12. Roller 40 is slightly shorter than sleeve 32 so that roller 40 does not come into contact with protector wheels 33; roller 40 can squeeze sponge sleeve 32 to a point below (inside) wheels 33.

The water squeezed out of sponge sleeve 32 is gravitationally deposited into a tank located below roller 40. The tank can be formed by a horizontal wall 54 and upstanding walls 55; both of these walls can connected with skirt walls 18 to form a water collection unit extending transversely along the full axial length of sponge sleeve 32. Periodically water can be drained from the tank through a drain tube 57 and manual valve 56 located on one of walls 18.

The preferred mechanism includes means for directing heated gas onto court surface 12 immediately behind roller 28. The heat will evaporate some, if not all, of the moisture remaining on the court surface. Various different systems can be used for applying heat to the court surface. The drawings show a blower 60 having a discharge nozzle means 62 directed angularly downwardly toward court surface 12 to force air into the narrow space beneath tank wall 54. Electric heater wires 64 are arranged in nozzle means 62 to heat the air being discharged onto the court surface.

Blower 60 can be a conventional commercial unit available on the open market; the principal requirement is that the blower have a discharge nozzle structure capable of supplying heated air to the entire court surface behind roller 28, i.e. a blast of air extending across substantially the entire axial length of roller 28. This requirement can be satisfied by using a blower of the "cross flow" or "line flow" type, as shown e.g. in U.S. Pat. No. 3,177,794 to N. Laing. The blower there shown includes two axially elongated blower housings defining an intervening space for a blower motor; an elongated rotor is located in each housing in driven relation to the motor. Air discharge is in the form of a narrow slot-like stream.

The present drawings depict a blower constructed generally similarly to the blower shown in U.S. Pat. No. 3,177,794. The blower will include an electric motor 63 mounted on wall 26, and two scroll housings 65 extending on either side of the motor (into or out of the plane of the paper in FIG. 1).

An electric power supply is required for heater wires 64 and blower motor 63. FIG. 1 schematically illustrates the electrical power supply as an internal combustion engine 67 and electric generator 69. A belt 70 is trained around pulleys on the engine drive shaft and generator shaft to transmit mechanical power to the generator. The generator will have electrical connections to motor 63 and heater wires 64.

Other systems could be used to deliver heated gas to the tennis court surface. For example, engine 67 could have a direct belt-drive connection to the rotors in blower 60, thereby eliminating motor 63. In another possible arrangement the hot engine exhaust could be used as a source of heated gas. The engine exhaust would then include a narrow nozzle extending transversely across the space between skirt walls 18.

The drawings show a push type mechanism wherein handle bars 72 are attached to skirt walls 18 to facilitate manual push movement of the mechanism. The mechanism could be a more elaborate self-propelled mechanism having a driver seat and steering capability.

I claim:

1. Mechanism for removing water from tennis courts, comprising:

a carriage that includes a horizontal platform (16) and two downwardly extending skirt side walls (18);

a first axially elongated relatively large diameter roller rotatably mounted on said carriage between said skirt side walls for rolling movement along a tennis court surface; said first roller having a sponge sleeve thereon adapted to absorb water as it contacts the court surface;

a second relatively small diameter roller mounted on said carriage between on skirt side walls and directly behind the relatively large diameter roller;

spring means biasing said small diameter roller into pressure contact with the surface of the sponge sleeve on the large diameter roller, whereby water is squeezed out of the sponge sleeve;

a water collection tank mounted on said carriage directly below the small diameter roller for collecting water that has been squeezed out of the sponge sleeve;

a horizontal axis blower mounted on the carriage below said platform and directly behind said water tank, said blower having a downwardly directed slot-like discharge nozzle (62) extending transversely between the skirt side walls; the transverse dimension of the nozzle being substantially the same as the axial dimension of the sponge sleeve on the relatively large diameter roller; and an engine mounted atop said platform for supplying power required to run said blower.

2. The mechanism of claim 1, and further comprising protector wheel means carried by said first roller for limiting the deformation of the sponge sleeve when it comes into contact with the tennis court surface; said protector wheel means including two protector wheels located at opposite ends of said first roller, each protector wheel having a diameter substantially greater than the roller diameter but less than the diameter of the sponge sleeve in its non-deformed condition.

* * * * *